United States Patent [19]

Boduch

[11] 3,967,731

[45] July 6, 1976

[54] STACKABLE LID AND CONTAINER

[75] Inventor: Stanley W. Boduch, Ludlow, Mass.

[73] Assignee: Dart Industries Inc., Los Angeles, Calif.

[22] Filed: Feb. 3, 1975

[21] Appl. No.: 546,842

[52] U.S. Cl. ..... 206/508; 206/511; 206/519; 220/306

[51] Int. Cl.[2] ..... B65D 21/04

[58] Field of Search ..... 206/508, 511, 518, 519, 206/520; 229/1.5 B, 43; 220/306

[56] References Cited

UNITED STATES PATENTS

| | | | |
|---|---|---|---|
| 3,094,240 | 6/1963 | Wanderer | 206/519 |
| 3,347,411 | 10/1967 | Kalata et al. | 206/519 |
| 3,374,922 | 3/1968 | Shelby | 229/1.5 B X |
| 3,396,868 | 8/1968 | Fitzgerald | 206/519 X |
| 3,396,899 | 8/1968 | Strouse et al. | 229/43 |
| 3,437,233 | 4/1969 | Rathbun | 206/508 |
| 3,504,823 | 4/1970 | Logomasini | 220/306 |
| 3,516,571 | 6/1970 | Roper et al. | 206/508 X |
| 3,612,342 | 10/1971 | Rathbun | 220/306 |
| 3,651,981 | 3/1972 | Kinney | 206/519 X |
| 3,743,133 | 7/1973 | Rathbun | 220/306 |

FOREIGN PATENTS OR APPLICATIONS

| | | | |
|---|---|---|---|
| 1,126,260 | 9/1968 | United Kingdom | 206/508 |

*Primary Examiner*—William Price
*Assistant Examiner*—Stephen Marcus
*Attorney, Agent, or Firm*—Kenneth J. Hovet; Harold R. Beck

[57] ABSTRACT

A stackable overcap lid and container combination wherein the container has vertically and horizontally offset annular beveled rim portions for stacking engagement with like portions of similar containers. The rim includes an upper flat lip portion for sealing engagement with an overcap lid. A film located across the container opening and bonded to the lip portion can be used to provide an additional seal. The overcap lid presents an intermediate annular offset portion adapted to seat a similar lid in a stacked relationship and includes a depending wide ring flange which facilitates the vertical stacking of lids and substantially inhibits their disarrangement.

7 Claims, 6 Drawing Figures

STACKABLE LID AND CONTAINER

BACKGROUND OF THE INVENTION

1. Field of the Invention

The present invention relates to containers and lids, and, more particularly, to a container and overcap lid combination each of which are readily stackable.

2. Description of the Prior Art

An important requirement in the design of containers and lids is that such may be readily formed with a minimum of complications while being adaptable for use with automatic feeding and dispensing apparatus. It is important that a container be readily filled with a foodstuff or the like and sealed by the use of an automatic container-filling and lid-dispensing machine. The lids when used with such equipment are customarily arranged in vertical stacks from which they are removed and placed over a container which has previously been filled with hot or cold solid, liquid or powder material. Each lid must be readily separated from the stack and must be adapted to become readily centered upon the container and form a reliable seal thereon. Additionally, both the container and lid must form a vertical stack without the likelihood of becoming dislodged or disarranged.

The prior art discloses numerous types of lids which are configured for stacking and/or guiding the lid over the container. Such assemblies are shown in U.S. Pat. Nos. 3,743,133 and 3,779,418. Because the lids disclosed in said patents provide inwardly extending areas for sealing engagement with the interior surfaces of the container, such areas inherently provide a stacking alignment means. However, the structure of overcap lids are not readily adapted to the placing or stacking of one upon the other for storage, shipment and/or dispensing from an automated lid-dispensing apparatus. Additionally, such lids commonly have a minimum sealing engagement with container lip portions.

SUMMARY OF THE INVENTION

The present invention includes a package comprising a container and overcap lid which are adapted to sealingly engage each other while also having the ability to be arranged in a vertical stack. The invention further includes a continuous film sealingly secured across the container opening. The overcap lid corresponds in shape to the container rim structure and includes a top central planar area extending to the peripheral edge. Offset inwardly from the edge is an annular groove concave in cross-section when the lid is viewed in an upright position. The underside of the groove is concentric with and sealingly engages the internal surfaces of a beveled portion adjacent the container sealing rim. The planar area between the peripheral edge and groove also sealingly engages the container rib structure. When a sealing film is used across the container opening, it is contemplated that the film will enhance the seal between the lid and container rim.

The lid includes a vertically extending rim portion which extends inwardly to define an inclined wall portion. The inclined wall portion terminates with an outwardly extending substantially horizontal offset seat portion which merges into a vertically extending ring flange. The diameter of the ring flange is about equal to or greater than the diameter of the vertical rim portion. Similarly the diameter of the vertical rim portion is about at least as great as the outer edge of the container sealing rim. In this manner the lid can readily be centered upon the container rim structure and form an effective seal therewith. Alternately, the overcap lid may have an indented central portion to facilitate vertical stacking of like packages.

The container includes a planar circular bottom portion having a concentric inverted frusto-concial central portion. The flat base portion extends from the base of the frusto-conical portion to the sidewalls of the container. The bottom portion includes an annular groove concave in cross-section when the container is viewed in an upright position.

The container sidewalls extend upwardly and outwardly and merge into a horizontal shoulder. This shoulder includes an upwardly and outwardly beveled radially outer end portion, the external surface of which engages a second beveled portion of the rim structure when like containers are nested in a stacked relationship. The first beveled portion merges into a slightly inwardly inclined annular wall portion. The upper end of the annular wall portion merges into a second upwardly and outwardly beveled top sealing portion.

The interior surfaces of the top sealing portion engage the first beveled external surfaces. The first beveled portion provides a seat for a like container stacked thereon. Additionally, the internal surfaces of the second beveled or sealing portion engages the annular groove of the lid as above described. The second beveled top sealing portion connects an integral horizontally extending sealing rim. The outer edges of the rim are of a diameter about equal to the inner diameter of the lid rim portion such that an effective seal will be formed thereby.

The container horizontal shoulder portion extends outwardly from the sidewalls and the annular inwardly inclined wall portion extends inwardly a distance such that when like containers are nested upon each other, the inner internal surface of the second beveled sealing portion engages the external surfaces of the first beveled portion. In this manner the sidewalls of the containers will be out of contact and the containers will thereby not become stuck together by frictional engagement of the sidewalls. Neither will a vacuum be formed upon compression and flexture of the rim structures thereby also rendering a separation of stacked containers difficult.

DESCRIPTION OF THE PREFERRED EMBODIMENT

Figure 1:
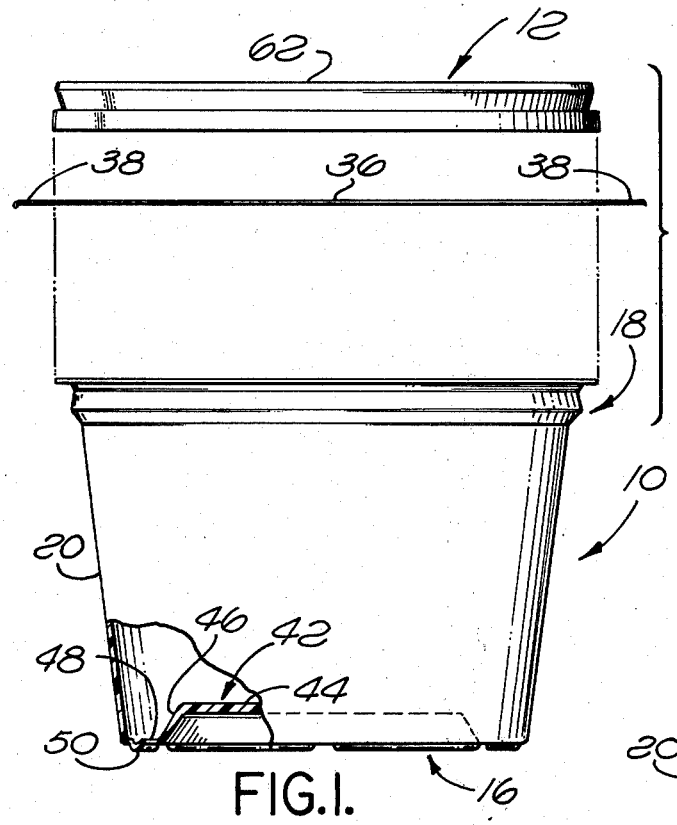
FIG. 1 is an exploded elevational view partly in cross-section of an overcap lid, sealing film and container constructed in accordance with the present invention.
Figure 4:
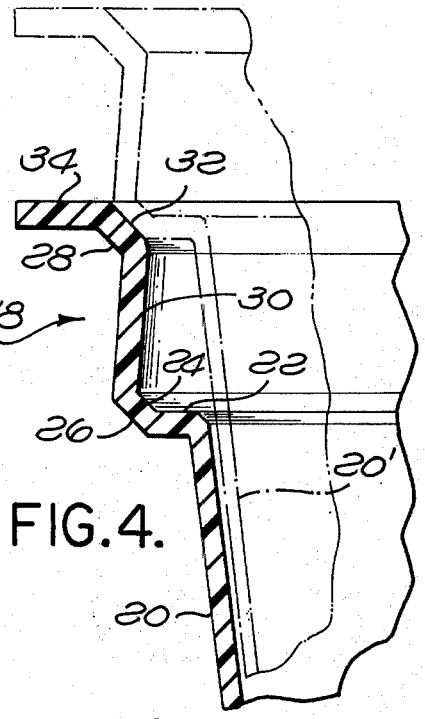
FIG. 4 is an enlarged fragmentary cross-section view of the container of FIG. 1 with an identical container shown in phantom stacked thereon.
Figure 2:
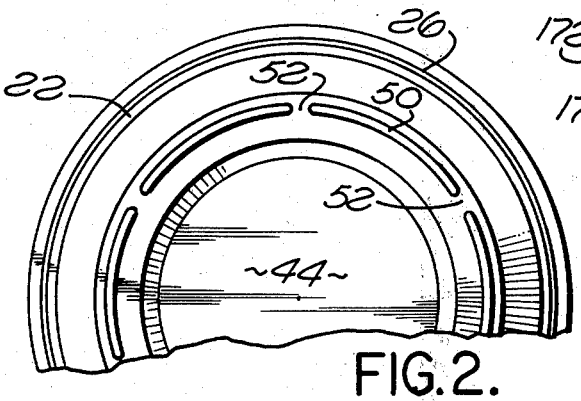
FIG. 2 is a bottom plan view partially broken away of the container of FIG. 1.

The container of the present invention shown generally by reference numeral 10 in FIG. 1, includes a bottom portion 16 with upwardly and outwardly flared sidewalls 20 merging into a rim structure shown generally by reference numeral 18. The rim structure 18 as best shown in FIG. 4 has a horizontal shoulder portion 22 joined by an upwardly and outwardly beveled end 24. The bevel 24 includes an external surface 26 which is adapted to matingly engage the inner surface 32 of a second beveled portion 28 to be hereinafter described.

The bevel 24 joins an upwardly extending slightly inwardly inclined annular wall portion 30. The wall portion merges into an upwardly and outwardly second beveled portion 28. The slope of surfaces 26 and 32 are substantially parallel so that the external surface 26 provides a substantially flat annular support area for nesting with an identical cup as shown in phantom in FIG. 4.

It is to be noted that the shoulder portion 22 extends outwardly and the inclined annular wall portion 30 extends inwardly and upwardly a predetermined distance such that when containers 10 are placed in a stacked relationship the sidewalls 20 and 20' will be spaced apart a slight distance. In this manner frictional contact and/or the formation of a vacuum during stacking, which would inhibit the unstacking of a vertical stack of containers, will be obviated. The internal beveled surface 32 is also important in that it serves to sealingly engage a grooved configuration in the lid structure to be hereinafter described.

The second beveled portion 28 is integral with a horizontal sealing rim 34. The rim is substantially flat, at least on its upper surface, to provide an effective sealing surface with the flat corresponding lid surface shown as 70 in FIG. 3. The flat rim also facilitates complete bonding of the optional sealing film 36 to the rim structure.

The bottom 16 of container 10 comprises a central upraised frusto-conical portion 42 having a flat top portion 44 with conical sidewalls 46. The base of the upraised portion merges into a bottom annular planar area 48 which connects with the container sidewalls 20. The bottom planar area 48 is provided with intermittent annular grooves 50 which, when the container is viewed in an upright position, are concave in cross-section. The grooves present a support surface concentric with the container periphery upon which the container rests. The grooves 50 may optionally be continuous annular configurations.

Figure 5:
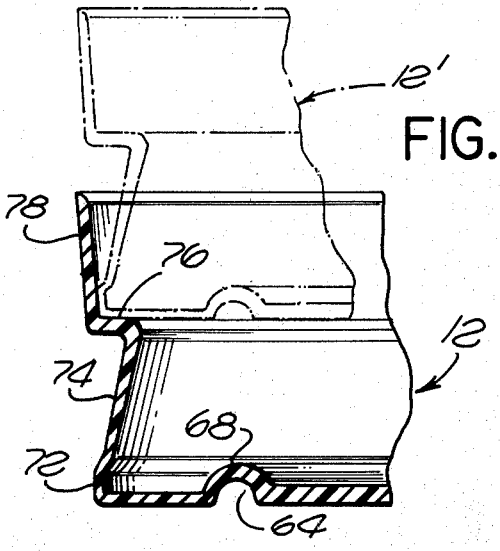
FIG. 5 is an enlarged fragmentary cross-section view of the overcap lid shown in FIG. 1 with an identical lid shown in phantom stacked thereon.
Figure 3:
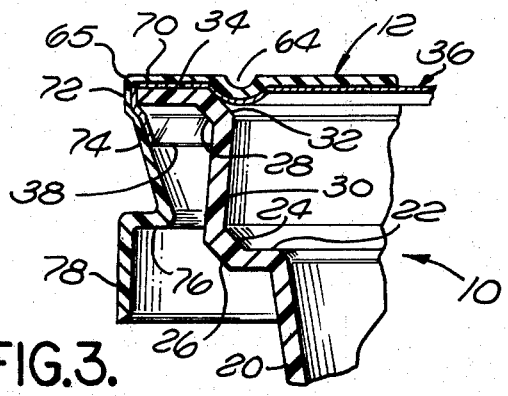
FIG. 3 is an enlarged fragmentary cross-section view of the overcap lid, sealing film, and container of FIG. 1 in an assembled condition.

Referring now to FIGS. 3 and 5 there is shown an overcap lid which generally seals and extends over the top and outer surfaces of the container rim structure 18. This is in contradistinction to the typical prior art lid structures which commonly form a seal with the inner rim surfaces by extending into the top interior of the containers a predetermined distance. The overcap lid of the present invention is circular in configuration and is adapted to frictionally engage and provide an effective seal with rim structure 18 of the container 10. Another feature of the lid 12 is that it provides an improved means for stacking whereby disarrangement or tipping of the stack is substantially prevented. Additionally, its construction inhibits jamming or other undesirable frictional engagement between lids when arranged in a vertical stack. A still further advantage is that the downwardly depending peripheral sidewall 74 and flange 78 serve to cover the somewhat unsightly sealing film portion 38.

The lid includes a top circular planar area 62 which includes an annular groove 64 concentric with the circular configuration of the lid. The groove is concave in cross-section when the lid is viewed in an upright position as shown in FIG. 3. The groove is offset radially inwardly from the lid edge 65 a distance corresponding to the width of the container sealing rim 34. In this manner the radially outwardly extending bottom surface 68 of the groove will engage the internal surface 32 of the second beveled portion. Additionally, the groove provides or facilitates centering of the overcap lid upon the container and operates to maintain the optional sealing film 36 in a taut condition.

The flat area 70 between the groove 64 and edge 65 is flat and thereby provides an effective seal with the flat sealing rim 34 or sealing film 36. The edge of the lid 65 merges into a substantially vertically extending rim portion 72. The rim portion extends vertically a distance at least equal to the thickness of the container rim 34 and then curves inwardly to define an inclined wall portion 74. The inclined wall portion merges into an outwardly extending substantially horizontal seat portion 76. The seat portion extends outwardly a predetermined distance so that it can function as a nesting means or support for the lids 12' when vertically stacked in an inverted position as shown in FIG. 5.

The seat portion 76 merges into an integral substantially vertical ring flange 78. The ring flange functions to prevent the dislodgement of the lids when such are placed in a stacked relationship. Note that the vertical extent of the ring flange is such that dislodgement of one lid over the flange of another would be virtually impossible. The flange also serves to cover the peripheral overlap 38 of the sealing film 36. To insure the proper spacing and the provision of a seat for stacked lids, the diameter of the vertical ring flange is at least about equal to the diameter of the rim portion 72.

Figure 6:
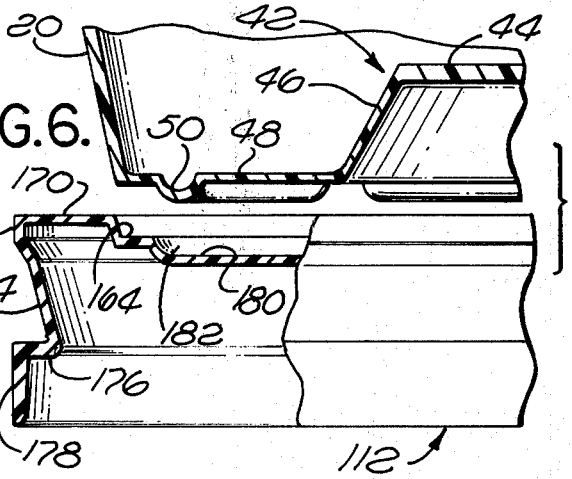
FIG. 6 is an exploded enlarged fragmentary cross-section view of the container and an alternative embodiment of the overcap lid of FIG. 1.

Referring now to FIG. 6, there is shown an alternative embodiment of the overcap lid referenced generally by numeral 112. This lid is provided with a central indented portion 180 having a curved circumferential sidewall portion 182. The sidewall portion is concentric with the grooves 50 and extends vertically a distance at least equal to the depth of the grooves. Similarly, an annular ledge portion 164 is provided which is integral with the sidewall and extends radially outwardly a distance at least equal to the outer diameter of the container bottom 16. In this manner, a seat is provided for the container bottom 16 and containers 10 can be readily stacked upon each other for ease of handling, shipment or storage. The lid portion 170, rim 172, sidewall 174, seat 176 and flange 178 are identical to their counterparts on the lid shown in FIGS. 3 and 5.

It will be appreciated that the container and overcap lid are thermoformed from thin plastic sheet materials and the structure of these provide an inherent resilience which facilitates the engagement therebetween and the formation of an effective seal. In particular, a seal is formed between surfaces 68 and 32 and between the lid portion 70 and rim portion 72 and container sealing rim 34. Of course, when optional sealing film 36 is interposed between the above surfaces, an even more effective seal will be created. It is contemplated that the film will be of a thermoplastic material and be stretched across the container opening, heat sealed to the flat rim 34 and trimmed preferably in accordance with the disclosure of patent application Ser. No. 492,561 filed July 29, 1974.

The construction of the overcap lids allows them to be placed in a jam-free nested relationship which facilitates their use with automatic stacking machinery. Likewise, the containers 10 with the matching beveled surfaces 26 and 32 operate to facilitate the stacking of containers in a vertical stack and yet make the separation of each container from the stack simple and easy.

While the invention has been described with respect to a preferred embodiment, it will be apparent to those skilled in the art that various modifications and improvements may be made without departing from the scope and spirit of the invention. Accordingly, it is to be understood that the invention is not to be limited by the specific illustrative embodiment but only by the scope of the appended claims.

I claim:

1. In combination:

a container having a bottom and integral upwardly and outwardly flared sidewalls merging into a horizontal shoulder, said shoulder having an upwardly and outwardly extending first beveled portion which joins an upwardly extending slightly inwardly inclined annular wall portion; said wall portion merges into an upwardly and outwardly extending second beveled portion connecting a flat horizontal sealing rim defining a top opening; and, a lid retained on said container over said top opening, said lid comprising a circular planar area having an annular groove concentric with the axis of said lid and radially offset inwardly from the peripheral edge thereof; said edge merging into a rim portion which extends substantially vertically a distance at least equal to the thickness of the container sealing rim and then inwardly to define an inclined wall portion which connects an integral outwardly extending substantially horizontal annular seat portion, said seat portion joining an integral substantially vertical ring flange.

2. The combination of claim 1 wherein said annular groove in said lid is concave in cross-section when viewed in an upright position and defines a circular configuration having a radius about equal to the radius of said second beveled portion.

3. The combination of claim 1 wherein the diameter of said vertical ring flange is at least about equal to the diameter of said rim portion.

4. The combination of claim 1 including a continuous film bonded to said sealing rim.

5. In combination:

a container having a bottom and integral upwardly and outwardly flared sidewalls merging into a horizontal shoulder, said shoulder having an upwardly and outwardly extending first beveled portion which joins an upwardly extending slightly inwardly inclined annular wall portion; said wall portion merges into an upwardly and outwardly extending second beveled portion connecting a flat horizontal sealing rim defining a top opening; and, a lid retained on said container over said top opening, said lid comprising a central indented portion having a curved circumferential sidewall which merges into an annular ledge portion, said ledge portion being vertically offset from an annular flat area which extends radially outward to a peripheral edge; said edge merging into a rim portion which extends substantially vertically a distance at least equal to the thickness of the container sealing rim and then inwardly to define an inclined wall portion which connects an integral outwardly extending substantially horizontal annular seat portion, said seat portion joining an integral substantially vertical ring flange.

6. The combination of claim 5 wherein said ledge is concentric with said peripheral edge and defines a seat for the bottom of said container.

7. The combination of claim 6 wherein said container bottom includes an annular planar area having at least one annular support groove, said groove being concentric with the circumferential sidewall of said lid and extends vertically a distance less than the depth of said circumferential sidewall.

* * * * *